United States Patent [19]

Beebe

[11] Patent Number: 4,561,698

[45] Date of Patent: Dec. 31, 1985

[54] WEAR PROTECTOR FOR TOOTH BRACKETS ON ROADWAY SURFACE CUTTING MACHINES

[76] Inventor: Donald E. Beebe, Box 464, Wapato, Wash. 98951

[21] Appl. No.: 623,022

[22] Filed: Jun. 21, 1984

[51] Int. Cl.[4] ..... E21B 10/62

[52] U.S. Cl. ..... 299/86; 299/92; 37/142 R

[58] Field of Search ..... 299/92, 93, 86; 37/142 A

[56] References Cited

U.S. PATENT DOCUMENTS

| | | | |
|---|---|---|---|
| T103602 | 11/1983 | Rettkowski | 299/10 |
| 3,512,838 | 5/1970 | Kniff | 299/92 |
| 3,746,396 | 7/1973 | Radd | 299/10 |
| 3,752,515 | 8/1973 | Oaks et al. | 287/52 R |
| 3,796,464 | 3/1974 | Hansen et al. | 299/92 |
| 3,830,321 | 8/1974 | McKenry et al. | 175/332 |
| 3,841,708 | 10/1974 | Kniff et al. | 299/92 |
| 3,865,437 | 2/1975 | Crosby | 299/86 |
| 3,957,307 | 5/1976 | Varda | 299/86 |
| 4,084,856 | 4/1978 | Emmerich et al. | 299/86 |
| 4,201,421 | 5/1980 | Den Besten et al. | 299/92 |
| 4,247,150 | 6/1981 | Wrulich et al. | 299/86 |
| 4,302,053 | 11/1981 | Roepke et al. | 299/86 |
| 4,333,687 | 6/1982 | Barnstorf | 299/81 |
| 4,335,921 | 6/1982 | Swisher, Jr. et al. | 299/86 |

*Primary Examiner*—Stephen J. Novosad
*Assistant Examiner*—M. Goodwin
*Attorney, Agent, or Firm*—Wells, St. John & Roberts

[57] ABSTRACT

A bushing and wear protector that is releasably received within the socket of a bracket to rotatably mount a wear tooth on a roadway surface cutting machine. The bracket includes a socket for normally receiving the shank of a wear tooth. The present bushing and wear protector includes a spring sleeve for encircling the tooth shank for rotatably securing the tooth within the bracket socket. The tooth is held firmly in axial position in relation to the bracket but will facilitate rotary movement of the tooth therein. The bushing and wear protector also includes integral shoulder and flange provisions to cover and protect exposed surfaces of the bracket to avoid wear by impact and abrasion with roadway material, and from abrasion and impact from the wear tooth itself. The protector will wear at approximately the same rate as the tooth so both can be replaced at normal tooth replacement intervals. The covered surfaces of the bracket, will be protected by the new bushing and wear protector provided with each change of wear teeth.

11 Claims, 6 Drawing Figures

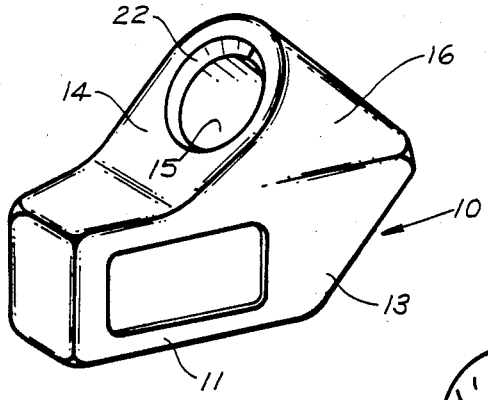
FIG 1
PRIOR ART
PRIOR ART
FIG 2
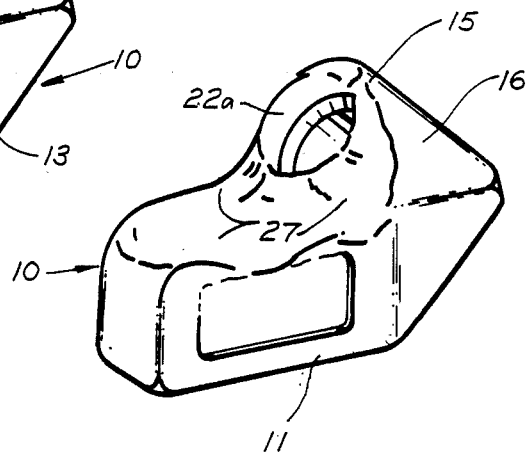
FIG 3
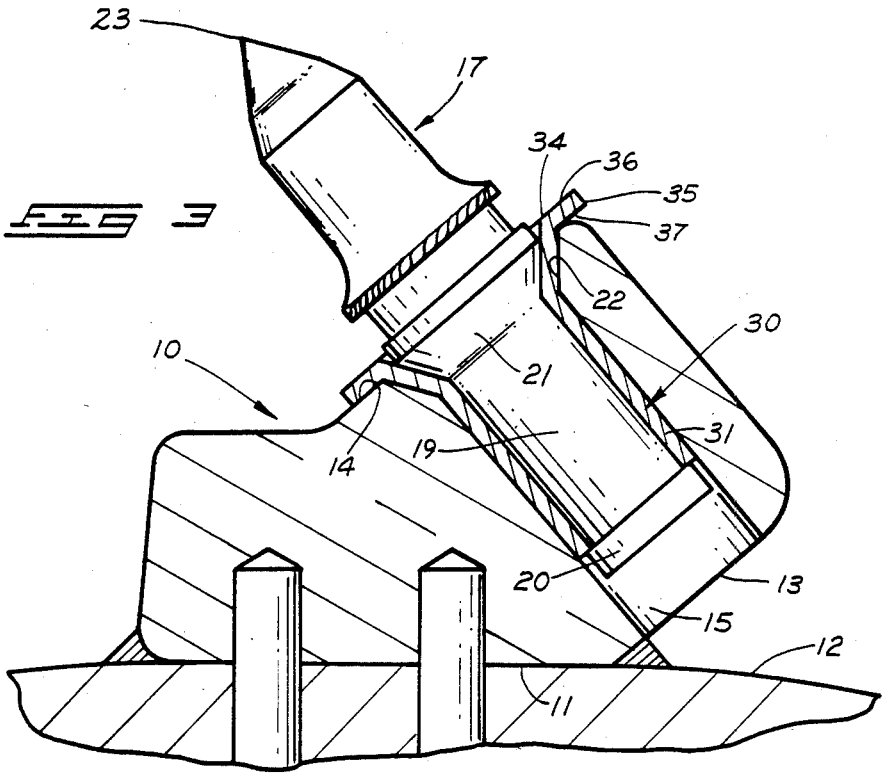

WEAR PROTECTOR FOR TOOTH BRACKETS ON ROADWAY SURFACE CUTTING MACHINES

FIELD OF THE INVENTION

The present invention relates to wear protection of mounting brackets that releasably secure roadway surface removal or cutting teeth mounted along a roadway surface cutting mandrel.

BACKGROUND OF THE INVENTION

Machines for removing roadway surface for replacement or repair often make use of a rotating cylinder ("mandrel") having spiral flights along the peripheral surface. A plurality of teeth or bits are mounted to the flights by replaceable brackets for engaging and cutting through the roadway surface as the mandrel rotates. The teeth are typically removable from the brackets. The brackets, in turn, may be removed from the mandrel flights for replacement.

Efforts have been made to extend the useful life of the cutter teeth. Probably the most significant advance has been development of teeth with cylindrical shanks mounted in brackets with lock sleeves that allow the teeth to rotate. A freely rotatable tooth will not constantly expose a single surface to wear. Instead, the tooth will wear evenly about its periphery.

Even with the above advancements, the cutting teeth must be replaced quite frequently. It is not unusual to replace a full set of teeth twice in a single nine-hour work shift. This wear is expected and accepted as unavoidable since the teeth are the elements used directly against the roadway surface for material break-up and removal.

Much attention has been given the cutter teeth due to the extreme wear factor and required frequency of replacement. But the brackets that mount the teeth also wear significantly. Consequently, they must be replaced periodically, though not nearly as frequently as the teeth. Brackets generally require replacement after about sixty work days.

Replacement of brackets, unlike tooth replacement, requires substantially more "down time" for the equipment. It is a time-consuming, labor-intensive chore to remove and replace brackets, especially those that have been welded in place. The per-unit cost of bracket replacement, including labor, is substantially more than the cost of wear teeth and labor for their replacement on the brackets. It therefore becomes desirable to acquire some form of protection for the brackets that will extend their useful life and consequently reduce the amount of "down time" and operating costs.

BRIEF DESCRIPTION OF THE DRAWINGS

A preferred form of the prevent invention is illustrated in the accompanying drawings in which:

FIG. 1 is a pictorial view of a conventional prior art form of bracket for mounting wear teeth to roadway surface repair vehicles;

FIG. 2 is illustrative of the same bracket only showing the configuration thereof after a wear period using standard cutting teeth;

FIG. 3 is a sectional view through a bracket showing the present wear protector in place mounting a wear tooth to the bracket;

DETAILED DESCRIPTION OF A PREFERRED EMBODIMENT

Figure 5:
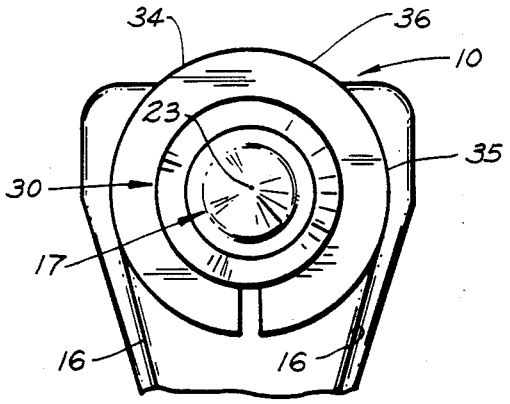
FIG. 5 is a fragmented end view showing the relationship between a wear tooth, present wear protector, and a bracket.

In compliance with the constitutional purpose of the Patent Laws "to promote the progress of science and useful arts" (Article 1, Section 8), applicant submits the following disclosure of the invention.

FIGS. 1 through 3 are illustrative of an existing form of bracket base 10 of the type generally used in roadway profiling or pavement removal. The bracket includes a relatively flat bottom or foot 11 that may be secured by appropriate fastening means such as welding to the flight of a rotatable mandrel 12 (FIG. 3).

The bracket 10 includes an upwardly inclined base end 13 that is spaced along an axis from a parallel angularly oriented face 14. An inclined socket or bore 15 extends through the bracket from an opening on the angled face 14 to a coaxial opening on the base end 13. The end 13 and face 14 are spaced apart by bracket side edge surfaces 16.

The socket 15 is provided to receive and mount a bit or wear tooth generally shown at 17 by FIG. 3. The wear tooth 17 is carried as shown in FIG. 3 to project ahead of the angled face 14 of bracket 10 to engage and cut through roadway surface material.

The wear tooth is substantially symmetrical about its longitudinal axis. It includes a substantially cylindrical shank 19 that is complementary in shape and length to the bracket socket 15. The shank is rotatably received within the socket. A shouldered butt end 20 of the shank is positioned within the bracket near the base end 13 to hold the wear tooth along its axis and facilitate removal therefrom by means of a hammer and punch.

The opposite end of the shank includes a flared shoulder 21. The shoulder is received by a complementary flared surface 22 formed at the mouth of the socket 15 and adjoining the angled face 14. The remainder of the wear tooth protrudes from the bracket to a wear point 23. The point 23 is typically formed of a hard, conical shaped surface. The point may thus be constructed of carbide steel while the remainder of the tooth can be formed of a softer, mild steel.

FIG. 2 illustrates a worn bracket. The original angled face 14 has been worn away as has the original flared surface 22 that originally joined the angled face 14 with the socket 15. A surface **22*a* somewhat similar to surface 22 is apparent deep within the socket. However, it is pointed out that the surface has been gradually deepened by successive wear teeth impacting the roadway surface. The ever deepening sockets produce an uneven setting for the teeth 17 and will eventually necessitate replacement of the brackets. Furthermore, worn surfaces 27 about the angled face 14 eventually weaken the material surrounding the tooth shank 19** and increase the possibility of breakage along the bracket socket.

Figure 4:
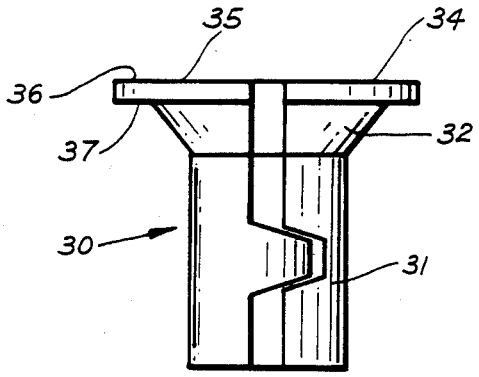
FIG. 4 is a side elevation view of the present wear protector.
Figure 6:
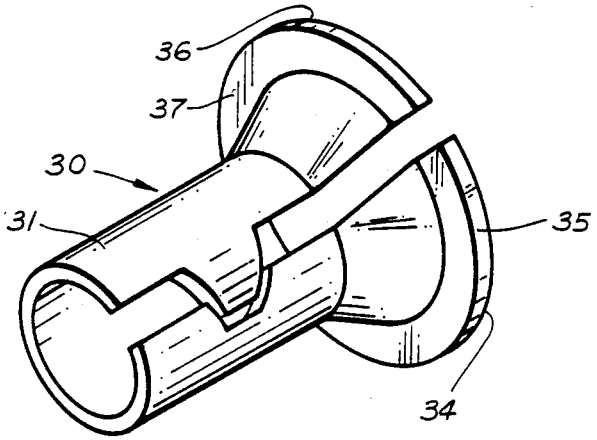
FIG. 6 is a pictorial view of the present wear protector.

It is the intent of the present bushing and wear protector to substantially decrease wear on the bracket in the vicinity of the angled bracket face 14 and flared shoulder surface 22 at the mouth of the bracket socket. It is also provided to rotatably receive the shank 19 of a tooth 17 and to be releasably received within the socket 15 such that the tooth is held firmly in place, yet will rotate freely about its longitudinal axis. The bushing 30 is shown in substantial detail by FIGS. 3 through 6.

Bushing 30 includes a split spring sleeve 31 to rotatably receive the tooth shank 19. The split spring sleeve 31 may be substantially equal in length to the tooth shank section extending between the shank butt end 20 and flared shoulder 21. The outside diameter of the split spring sleeve 31 is normally slightly greater than the inside diameter of the bracket socket 15. The split sleeve includes a fissure or slot along its length to facilitate crimping of the spring material to allow the tooth to be driven into and out of a bracket socket 15. The spring tension in the sleeve section 31 will press the outside surface of the sleeve against the walls of the socket and thereby firmly hold the tooth axially in position. The inside diameter of the sleeve, even when compressed, loosely encompasses the tooth shank to facilitate free rotational movement thereof about the longitudinal tooth axis.

A flared shoulder 32 is formed integrally at an end of the split spring sleeve 31. The flared shoulder 32 is angled to meet with the similarly flared shoulder 21 of the bracket socket. The wear protector shoulder 32 will therefore receive the bulk of impact produced from the tooth at its shoulder 22 as the point is driven into roadway surfaces. The shoulder 32 will also accept much of the abrasion created by the tooth as it rotates about its axis during use. The shoulder 32 will therefore protect the bracket shoulder 21 from becoming worn like the surface 22*a* as indicated in FIG. 2.

Another important provision in the present bushing and wear protector 30 is an annular flange 34. The flange 34 extends substantially radially outward from the flared shoulder 32 of the bushing. Like shoulder 32, the flange 34 is preferably formed as an integral part of the bushing and wear protector 30.

The annular flange 34 extends outward to a substantially circular peripheral edge 35. It includes an axial forwardly facing surface 36 and a parallel rearward facing surface 37. The rearward surface 37 will be received in flush engagement with the angled bracket face 14, overlapping the surface to the bracket side edges 16.

In practice, it is preferred that the annular flange 34 extend at least one-fourth inch from the flared shoulder section 32 in order to cover a sufficient amount of the bracket to prevent weakening of the bracket walls surrounding the socket. The forwardly facing surface 36 will be exposed to abrasion from material broken by the tooth 19 and will wear at a rate substantially coincident with the wear rate of the tooth.

As indicated above, it is preferable to form the present bushing and wear protector 30 as an integral, one piece unit. Additionally, it is desirable to form the entire bushing and wear protector 30 from spring steel of a 0.050 inch thickness dimension. This material thickness and steel grade can be formed, for example, by existing stamping processes to the configuration shown. Furthermore, the characteristics of the spring steel and thickness extend the useful life of the bushing and wear protector 30 to at least equal that of the associated tooth. The bushing and wear protector will therefore continue protecting the important adjacent surfaces of the bracket against wear from abrasion and impact with roadway surface material until the associated tooth has also worn away. The wear protector 30 and tooth should then be removed and replaced. Only continued use of the machine with badly worn teeth 17 will result in wear of the protector 30 to the extent that the bracket 10 will be effected.

The entire assembly, including the wear protector 30 and tooth 17 can be removed from the associated bracket to permit replacement with a fresh bracket and tooth assembly. This is accomplished in the same manner as with conventional wear teeth and lock sleeves. The tooth and wear protector 30 may be removed by inserting a punch through the socket opening at the bracket base end 13. The punch is positioned against the butt end of the tooth shank and is tapped with a hammer to drive the shank and wear protector 30 axially and forwardly out from the socket.

A fresh tooth and wear protector assembly can then be inserted. This is done by placing the butt end of the shank into the bracket socket and tapping the tooth point with a soft headed mallet or hammer. The spring sleeve 31 will compress inwardly against the walls of the socket and slide axially inward until the wear protector shoulder 32 comes into flush engagement with the complementary shoulder 22 formed adjacent the angled face 14 of the bracket. At the same time the back or rearward surface 37 of the annular flange 34 will come into close proximity if not flush abutment with the angled face 14. A fresh water surface overlapping the angled face and shoulder of the bracket is thus provided to prevent wear of the bracket during use of the new replacement tooth.

It is eliminated that the present bushing and wear protector 30 will effectively extend the useful life of the brackets to approximately one year. This represents a significant increase in the useful life of the brackets and substantially reduces operating costs by eliminating the need for excessive "down time", labor and cost of materials as evidenced in the past when such brackets required removal and replacement at approximate sixty day intervals.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A bushing and wear protector mountable along with a roadway surface removal wear tooth to a bracket, the wear tooth including an elongated shank formed along a central axis and leading axially from a butt end to a flared shoulder and a wear tip extending axially from the shoulder to a pointed end, and with the bracket including a shank receiving socket and having a bracket face surface encircling the socket and extending to peripheral bracket side edges, wherein the bushing and wear protector is comprised of:

an elongated spring sleeve having a spring sleeve thickness dimension between an inside spring sleeve wall and an outer wall, for rotatably receiving the wear tooth shank and for being removably received securely within the bracket socket;

wherein the spring sleeve includes an integral flared shoulder section of substantially equal thickness to the spring sleeve thickness dimension for rotatably receiving the flared shoulder of the wear tooth; and an integral annular flange extending from the flared shoulder section to a peripheral edge and having a thickness dimension substantially equal to that of the spring sleeve thickness dimension, for covering the bracket face to the peripheral bracket side edges to prevent wear thereof and wherein the flange thickness dimension is such that the annular flange will wear at a rate substantially equal to that of the wear tooth.

2. The bushing and wear protector as claimed by claim 1 wherein the flange includes a flat surface oriented in a plane transverse to the spring sleeve for flush overlapping engagement with the face surface of the bracket.

3. The bushing and wear protector as claimed by claim 1 wherein the spring sleeve, integral flared shoulder and flange are split along an axial fissure.

4. The bushing and wear protector as claimed by claim 3 wherein the spring sleeve, integral flared shoulder and flange include a substantially common thickness dimension and are formed of spring steel.

5. The bushing and wear protector as claimed by claim 4 wherein the flange includes a substantially circular peripheral edge spaced radially outward of the integral flared shoulder.

6. The bushing and wear protector as claimed by claim 1 wherein the split spring sleeve is cylindrical about a sleeve axis and wherein the annular flange extends radially from the flared shoulder section by a distance of approximately ¼ inch.

7. The bushing wear protector as claimed by claim 1 wherein the spring sleeve, integral flared shoulder, and annular flange are formed of spring grade steel and include a common thickness dimension of approximately 0.050 inches.

8. In a bracket and wear tooth assembly including a bracket having a bracket face oriented transversely to an open tooth receiving socket and a wear tooth having a wear tip and an elongated shank to be received within the socket, a bushing and wear protector comprising:

a split spring sleeve for rotatably receiving the wear tooth shank and having an external surface for releasably gripping the bracket from within the socket and having an internal surface for holding the wear tooth within the socket while allowing free rotation thereof about a central axis and a thickness dimension between the internal and external surfaces;

an annular flange, integral with and having a thickness dimension substantially equal to the split spring sleeve, said flange extending outward of the split spring sleeve to overlap the bracket face to prevent wear of the bracket about the open tooth receiving socket and to wear at a rate substantially equal to that of the wear tooth.

9. The combination of claim 7 further comprising an integral flared shoulder section intermediate the annular flange and spring sleeve.

10. The combination of claim 7 wherein the split spring sleeve and annular flange include a common thickness dimension.

11. The combination of claim 7 wherein the spring sleeve and annular flange are formed of spring grade steel and include a common thickness dimension of approximately 0.050 inches.

* * * * *